US007604147B2

(12) United States Patent
Anderson

(10) Patent No.: US 7,604,147 B2
(45) Date of Patent: Oct. 20, 2009

(54) KEG WITH AN INNER BAG

(75) Inventor: Ian Anderson, Burwell (GB)

(73) Assignee: Anheuser-Busch InBev S.A., Leuven (BE)

( * ) Notice: Subject to any disclaimer, the term of this patent is extended or adjusted under 35 U.S.C. 154(b) by 716 days.

(21) Appl. No.: 10/536,979

(22) PCT Filed: Nov. 25, 2003

(86) PCT No.: PCT/IB03/05397

§ 371 (c)(1),
(2), (4) Date: Dec. 20, 2005

(87) PCT Pub. No.: WO2004/050540

PCT Pub. Date: Jun. 17, 2004

(65) Prior Publication Data

US 2006/0144870 A1 Jul. 6, 2006

(30) Foreign Application Priority Data

Nov. 29, 2002 (GB) ..... 0227938.8

(51) Int. Cl.
*B65D 83/00* (2006.01)

(52) U.S. Cl. ..... 222/400.7; 222/95; 222/105; 222/183

(58) Field of Classification Search ..... 222/400.7, 222/105, 400.8, 95, 129, 129.1, 183, 325, 222/399; 220/835; 137/212, 322, 614.04, 137/614.05; 285/26–27
See application file for complete search history.

(56) References Cited

U.S. PATENT DOCUMENTS 3,240,392 A 3/1966 Nicko ..... 222/82
3,354,022 A 11/1967 Dettre et al.

(Continued)

FOREIGN PATENT DOCUMENTS

CH 268258 8/1950

(Continued)

OTHER PUBLICATIONS

W. Barthlott et al., "Lotus-effekt und autolack: die selbstreinigungsfähigkeit mikrostrukturierter oberflächen", Biologie in Unserer Zeit, No. 5, pp. 314-321, 1998.

(Continued)

*Primary Examiner*—Frederick C. Nicolas
(74) *Attorney, Agent, or Firm*—Levy & Grandinetti

(57) ABSTRACT

An interlocking collar (72) secures a bag neck (46) in a keg aperture (42) of an alcohol beverage keg container (22). The interlocking collar is mounted in press fit surrounding relation with a peripheral wall portion of the bag neck. The collar has an outer peripheral wall portion sized larger than that of a keg aperture. The collar (72) has a recessed groove (76) in the collar outer peripheral wall portion for receiving in press fitting and sealing relation a keg flange (40) that defines the keg aperture. The collar outer peripheral wall portion has a resilient edge portion (78) adjacent the recessed groove that deflects to permit the interlocking collar to pass through the keg aperture and receive the keg flange in the recessed groove. The interlocking collar has a plurality of locking passageways (80) placed around the interlocking collar and axially extending through the interlocking collar between the neck and recessed groove. A latch member (82) has a plurality of locking fingers (84) that extend axially through the locking passageways to prevent deflection of the resilient edge portion of the interlocking collar after the collar is placed in the keg aperture.

10 Claims, 4 Drawing Sheets

U.S. PATENT DOCUMENTS

| | | | | |
|---|---|---|---|---|
| 4,265,374 | A * | 5/1981 | Sebalos | 222/95 |
| 5,122,518 | A | 6/1992 | Vrab | |
| 5,435,460 | A * | 7/1995 | Osgar | 222/1 |
| 6,015,068 | A | 1/2000 | Osgar et al. | 222/400.7 |
| 6,237,809 | B1 * | 5/2001 | Kawai et al. | 222/95 |
| 6,516,839 | B1 * | 2/2003 | Timp et al. | 141/347 |
| 6,824,017 | B2 * | 11/2004 | Sluijter | 222/153.04 |
| 2002/0150723 | A1 | 10/2002 | Oles et al. | |
| 2005/0103457 | A1 | 5/2005 | Nun et al. | |

FOREIGN PATENT DOCUMENTS

| | | |
|---|---|---|
| DE | 1 467 023 | 1/1969 |
| DE | 1 806 288 | 5/1970 |
| DE | 100 22 246 | 11/2001 |
| EP | 1 153 987 | 11/2001 |
| EP | 1245526 A1 | 10/2002 |
| FR | 2138685 | 1/1973 |
| JP | 7-328532 | 12/1995 |
| WO | 96/04123 | 2/1996 |
| WO | 97/29157 | 8/1997 |
| WO | 03/008697 | 1/2003 |

OTHER PUBLICATIONS

A. Abramson, "Schriftenreihe Fine Particles, No. 11, Grundlagen von Aerosil", Aerosil & Silanes, Degussa 1982.

"Schriftenreihe Fine Particles, No. 18, Hydrophobe Aerosil-Typen und ihr Einsatz in der Lackindustrie", Creating Essentials, Degussa.

Guenther Michael et al., "Technical Bulletin Pigments, Basic Characteristics of Aerosil, No. 11", Degussa.

* cited by examiner

KEG WITH AN INNER BAG

FIELD OF THE INVENTION

The present invention relates to an interlocking collar for securing an alcohol containing bag within a keg container.

BACKGROUND OF THE INVENTION

It is known to contain alcohol, such as wine, in bags contained in a cardboard type container. Further, it is known to use a bag inserted into a keg for storing beer in the bag. In the case of a beer keg, the bag is inserted into the keg container prior to the beer being filled into the bag. Once the bag is filled with beer, the bag is usually maintained under pressure to facilitate the dispensing of beer from the keg container. There is a need to provide an effective seal between the bag and the keg that is cost effective and resists explosive relief from the keg when the keg is pressurized.

SUMMARY OF THE INVENTION

It is an object of the present invention to provide a cost effective seal for securing a bag in a keg container such that the bag is self-contained in the container during normal filling and dispensing of alcohol from the bag.

It is another object of the present invention to provide a seal for securing a bag in a keg container where the seal works well in conjunction with a simple embossed keg neck.

The present invention relates to an interlocking collar for mounting a bag neck in a keg aperture of an alcohol beverage keg container. The interlocking collar is mounted in press fit surrounding relation with a peripheral wall portion of the bag neck. The collar has an outer peripheral wall portion sized larger than that of a keg aperture. The collar has a recessed groove in the collar outer peripheral wall portion for receiving in press fitting and sealing relation a keg flange that defines the keg aperture. The collar outer peripheral wall portion has a resilient edge portion adjacent the recessed groove that deflects to permit the interlocking collar to pass through the keg aperture and receive the keg flange in the recessed groove.

The interlocking collar provides a cost effective seal for securing a bag in a keg container such that the bag is self-contained in the container during normal filling and dispensing of alcohol from the bag. Further, the seal works well with the simple flange aperture of the keg.

It is envisaged that the interlocking collar has a plurality of locking passageways placed around the interlocking collar and axially extending through the interlocking collar between the neck and recessed grove. The assembly further comprises a latch member with a plurality of locking fingers adapted to extend axially though the locking passageways to prevent deflection of the resilient edge portion of the interlocking collar after the collar is inserted in the keg aperture.

In accordance with an aspect of the present invention there is provided an alcohol beverage container assembly comprising a keg having a flange that defines a keg aperture. The container assembly comprises a bag contained in the keg for containing an alcohol beverage. The bag has a neck for supporting the bag in the keg. The neck has a peripheral wall portion sized less than that of the keg aperture. The neck has a central passageway extending into the bag that is adapted to receive a beverage filling and dispensing valve assembly. The container comprises an interlocking collar mounted in press fit surrounding relation with the peripheral wall portion of the neck. The collar has an outer peripheral wall portion sized larger than that of the keg aperture. The collar has a recessed groove in the collar outer peripheral wall portion for receiving the keg flange in press fitting and sealing relation therewith. The collar outer peripheral wall portion has a resilient edge portion adjacent the recessed groove that deflects to permit the interlocking collar to pass through the keg aperture and receive the keg flange in the recessed groove.

BRIEF DESCRIPTION OF THE DRAWINGS

For a better understanding of the nature and objects of the present invention reference may be had to the accompanying diagrammatic drawings in which.

DETAILED DESCRIPTION OF THE INVENTION

Figure 1:
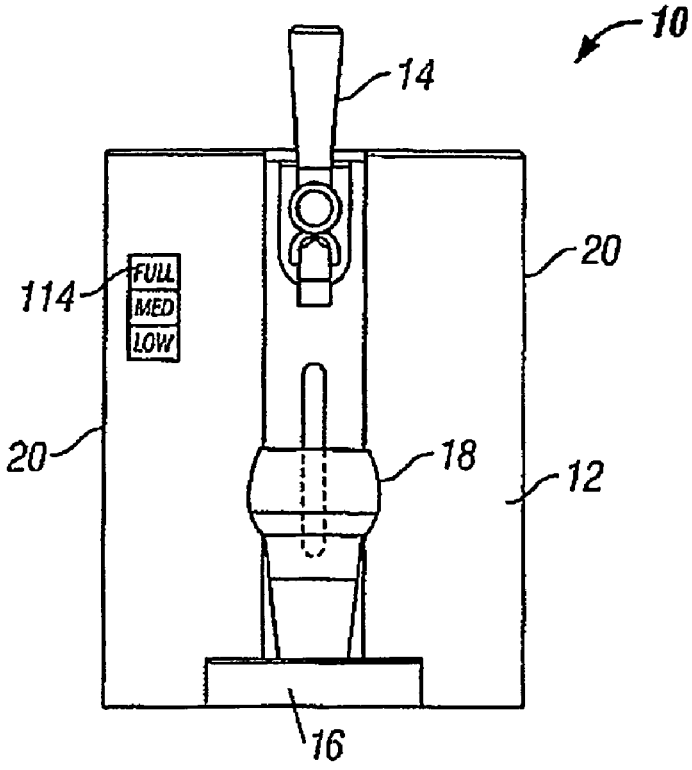
FIG. 1 is a front elevation view of a home beer dispensing apparatus in accordance with the present invention.
Figure 2:
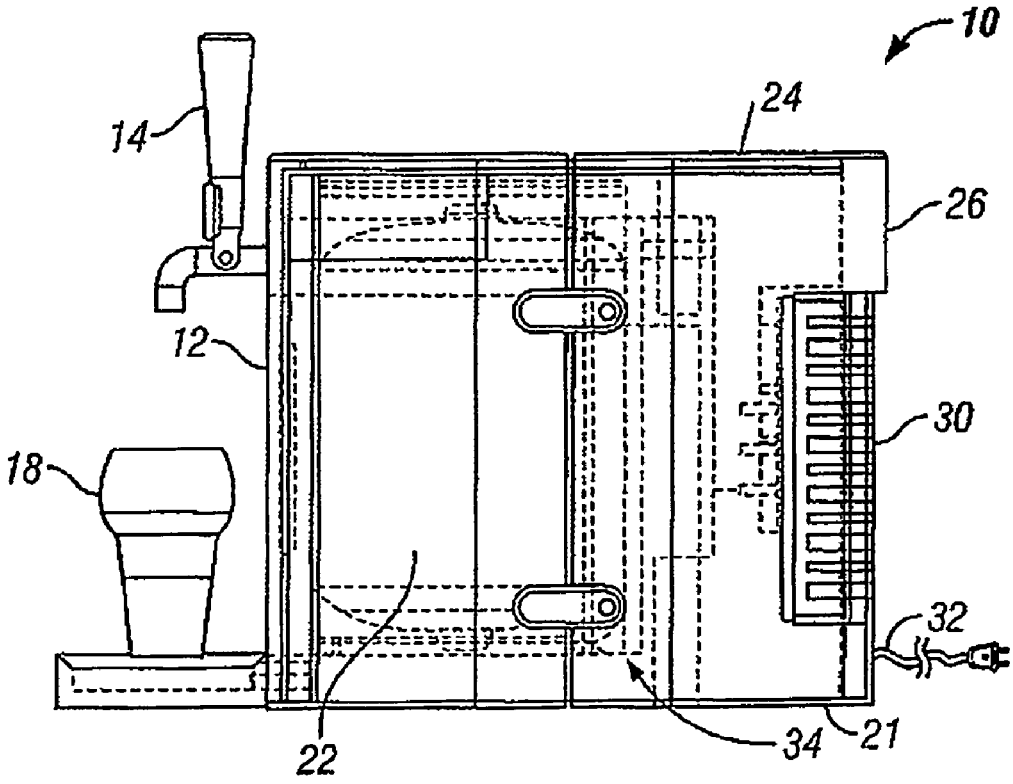
FIG. 2 is a side elevation view of the home beer dispensing apparatus.
Figure 3:
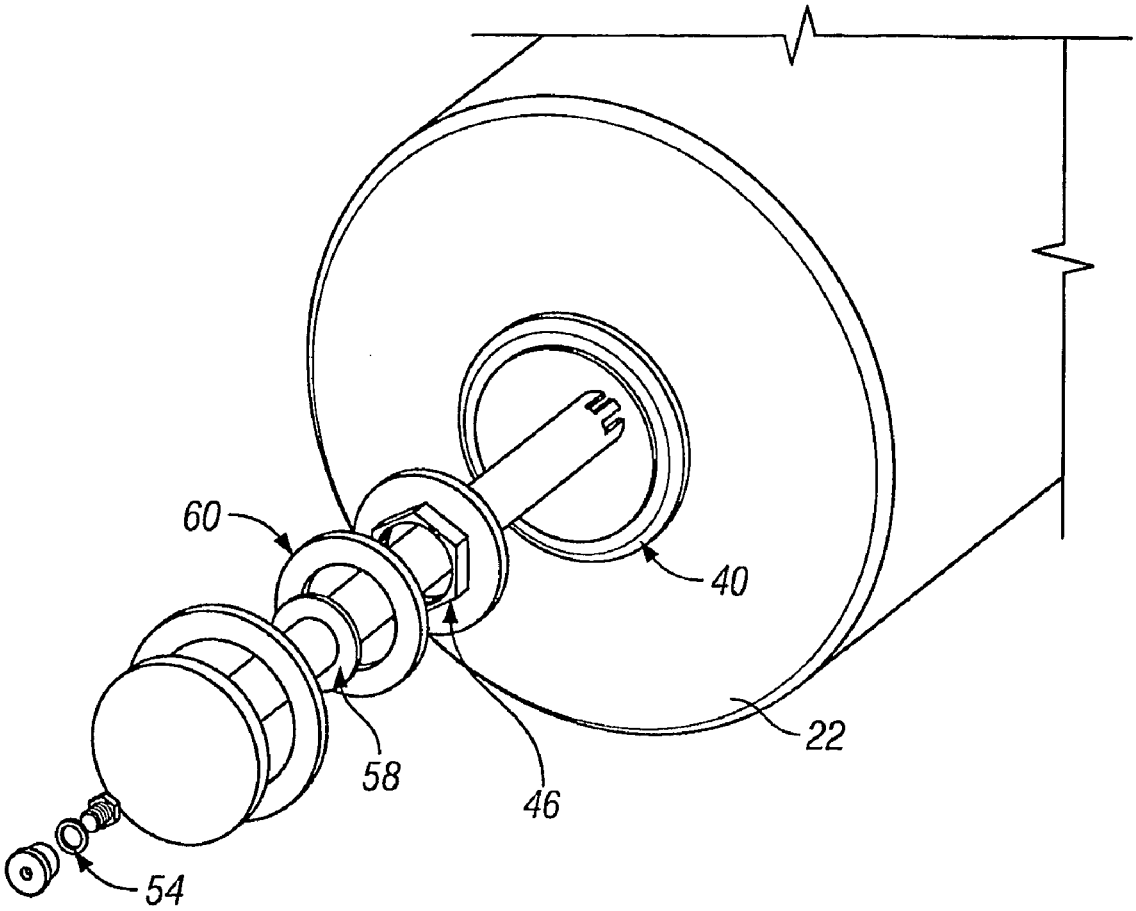
FIG. 3 is an exploded view of the valve, bag, and spear assembly for the alcohol container of the present invention.
Figure 5:
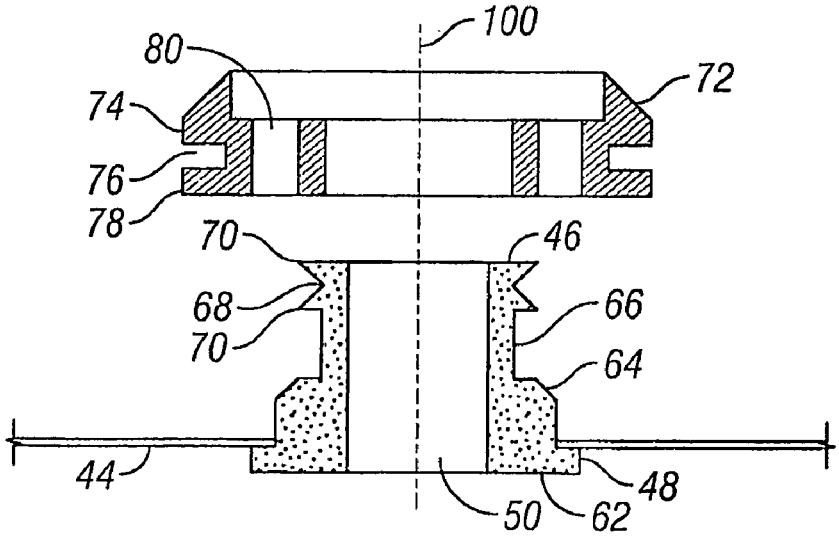
Figure 4:
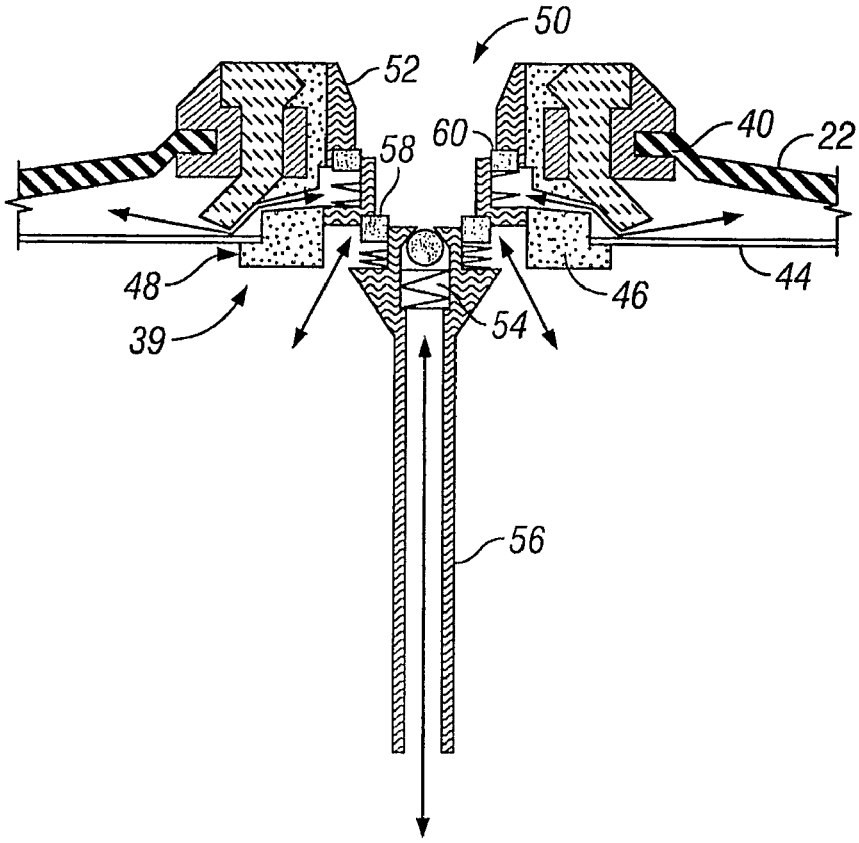
FIG. 4 is a side sectional view of the interconnecting collar and valve assembly; and, FIGS. 5 to 8 are partial side sectional views showing the assembly of the bag, interlocking collar and latch member in the keg.

Referring to FIGS. 1 and 2 there is shown a home beer dispensing apparatus, appliance or unit 10. The dispensing apparatus 10 is primarily intended for use in domestic kitchens but may also be used in utility rooms, garages, domestic bars, caravans etc. While the preferred embodiment relates to dispensing beer, alternatively carbonated solutions or other alcohol beverages may be dispensed by apparatus 10.

The home beer dispensing apparatus 10 has a front wall 12 and a dispensing tap 14 protruding forward of the front wall 12. A drip tray 16 also protrudes forward of the front wall 12 and is adapted to support an open glass container 18 below the dispensing tap 14. The home beer dispensing apparatus 10 further has a base 21 adapted to rest on a counter top. The front wall 12 is an extension of two pivoting side walls 20 which may be moved between closed and open positions to allow the keg 22 (see FIG. 2 in broken lines) to be inserted into the housing of the home beer dispensing apparatus 10.

The housing of the home beer dispensing apparatus 10 further includes a top wall 24 and a rear wall 26. The rear wall 26 has a grill 30 that permits for air circulation within the home beer dispensing apparatus 10. An electrical cord 32 extends through the rear wall 26 of the apparatus 10 to provide a connection into a main electrical supply to supply electrical power to the electrical components housed within the unit 10. Alternatively, a 12 Volt DC supply input may be used.

The dispensing apparatus 10 has a cooling system 34 located behind and below keg 22 that is adapted to cool beer in keg 22 when keg 22 is placed into dispensing apparatus 10

Referring to FIGS. 3 to 8, there is shown the container assembly 39 of the present invention.

Figure 7:
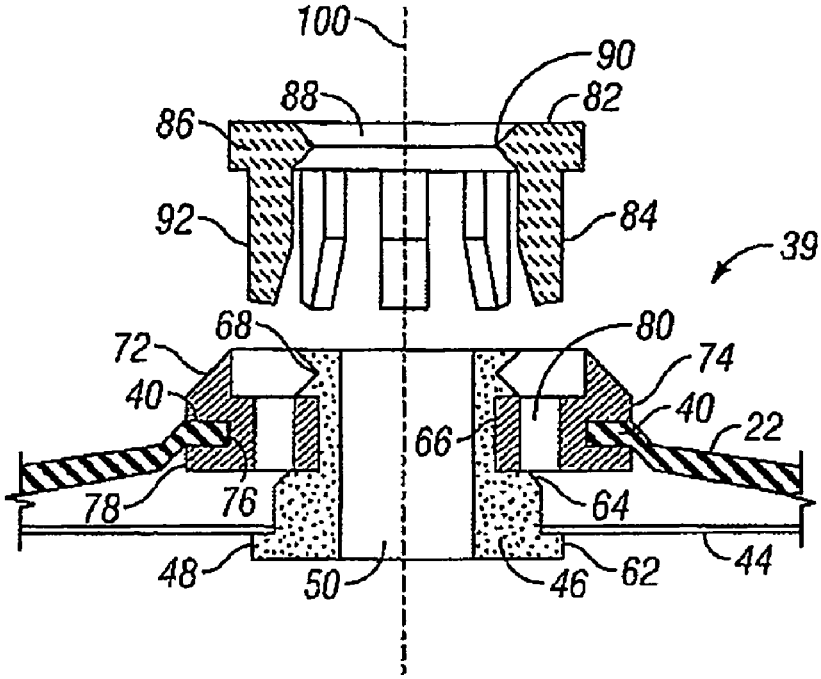
Figure 8:
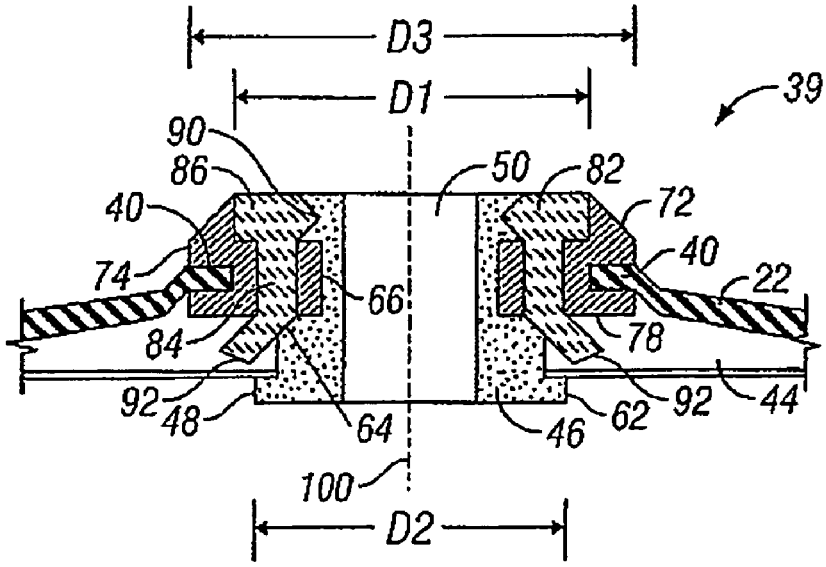

The container assembly 39 comprises a keg 22 having a simple embossed raised flange 40 that defines an aperture 42 (see FIG. 7) having a first predetermined diameter D1 (see FIG. 8).

Mounted or passed through the keg aperture 42 is a plastic bag 44. The plastic bag preferably comprises a polypropylene material. The bag 44 is contained in the keg 22 and is adapted for housing an alcoholic beverage which preferably is beer. The bag 44 has a rubber neck 46 that supports the bag 44 within the keg 22. The neck 46 has a peripheral wall portion 48 of a second predetermined diameter D2 which is less than the first predetermined diameter D1 of the keg aperture 42. The neck 46 has a central passageway 50 extending into the bag 44. Central passageway 50 is adapted to receive a valve body 52 (see FIG. 4) which is utilized for filling the bag 44 with beverage and for dispensing from the bag 44 the alcohol beverage.

The valve body 52 has a first central beverage valve 54 which is connected in fluid communication to a hollow spear 56 which extends into the bag 44. The valve 54 is opened to permit the insertion of the beer into the bag. Further, valve 54 is open during the dispensing of beer through spear 56, and out through tap 14 (FIG. 1). The valve body 52 further includes a second concentric valve 58 spaced radially out from the center valve 54. The second concentric valve 58 controls gas flow into the bag 44. Typically, a charging gas such as, for example, carbon dioxide or nitrogen is used to inflate the bag 44 prior to the bag 44 being filled through valve 54 with beer.

The valve body 52 further includes a third valve 60 which is concentric to the second valve 58. The third valve 60 controls flow of air into keg 22 exterior of the bag 44 so as to provide an air pressure to the bag 44 that facilitates the dispensing of beer from bag 44. The air valve 60 is also used to allow air to escape the keg 22 when the bag 44 is being inflated with a charging gas through the second valve 58.

Referring to FIGS. 5 to 8, the peripheral outer wall portion 48 of neck 46 includes an out turned flange 62 from mounting the bag 44 to the neck 46. The neck has an inwardly tapering wall 64 that is axially spaced parallel to axis 100 adjacent the out turned flange 62. The neck 46 has a first recessed slot 66 that extends around the neck and is axially spaced adjacent the inwardly tapering wall 64. The neck 46 has a second recessed slot 68 that extends around the neck and is axially spaced adjacent the first recessed slot 66. As shown in the drawings, the second recessed slot 68 comprises a v-shaped recessed notch that has resilient tip portions 70.

Figure 6:
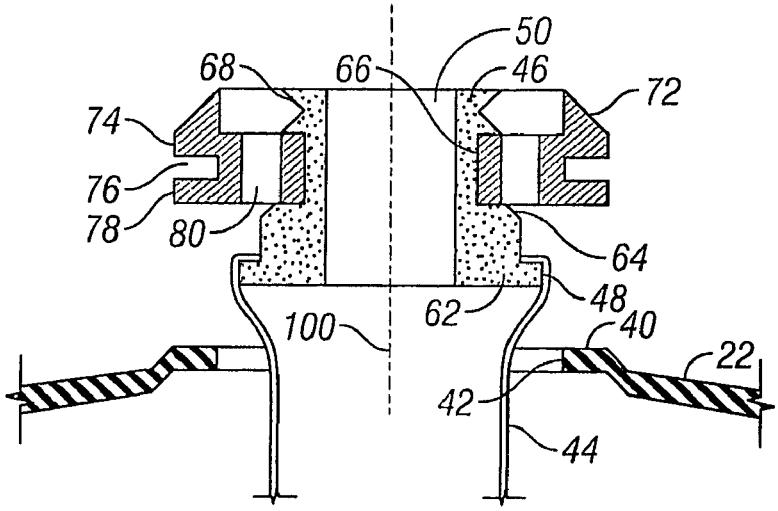

The container assembly 39 further includes an interlocking collar 72 that is mounted in pressed fit surrounding relation with the peripheral wall portion 48 of the neck 40. As shown in FIG. 6, the interlocking collar 72 is adapted to be received in the first recessed slot 66 of the neck 46 in pressed fit sealing relationship therewith. The collar 72 has an outer peripheral wall portion 74 having a third predetermined diameter D3 which is greater than the first predetermined diameter D1 of the keg flange 40. The collar 72 has a recessed groove 76 located in a collar outer peripheral wall portion 74. The recessed groove 76 receives the keg flange 40 in pressed fitting relation therewith. The collar outer peripheral wall portion 74 has a resilient edge portion 78 adjacent the recess groove 74 that deflects to permit the interlocking collar 72 to pass through the keg aperture 42 to receive the keg flange 40 in the recessed groove 76 in pressed fitting and sealing relation therewith.

The interlocking collar 72 also has a plurality of locking passages 80 that are spaced around the interlocking collar 72 by a predetermined distance from axis 100. The locking passageways 80 extend axially through the interlocking collar 72 between the neck 46 and the recessed groove 76.

The container assembly 39 has a latch member 82 (see FIG. 7) with a plurality of locking fingers 84 adapted to extend axially through the locking passageway 80 to prevent deflection of the resilient edge portion 78 of the interlocking collar 72.

The latch member 82 has a support base 86 from which the locking fingers 84 extend. The support base 86 has an inner aperture 88 that defines an inwardly directed flange 90 that is adapted to be received within the recessed slot 68. This flange 90 has a wedge shape that is adapted to be received in the v-notch shape of the second recessed slot 68 in a press fit, sealing and locking relationship therewith. The locking fingers 84 extend through the locking passageways 80. The locking fingers 84 have a lead in finger tip portion 92 that passes through the locking passageways 80 and are curved slightly outwardly. The finger tip portions 92 abut the tapered wall 64 of the neck 46 to be forced into locking engagement with the resilient edge portion 78 of the interlocking collar 72.

During normal assembly of the container 39, the interlocking collar 72 is inserted on the bag neck 46 as shown in FIG. 6. Thereafter, the bag neck 46 is pushed into sealing engagement with the flange 40 of the keg 22 as shown in FIG. 7. This is accomplished by the edge portion 78 of the collar 72 deflecting to permit the collar 72 to pass through the flange aperture or keg aperture 42 and the edge portion 78 springs back into place locking the flange 42 in the recessed groove 76 of the interlocking collar 72. Next, the latching member 82 has its locking fingers 84 pushed into corresponding locking passages 80 such that the inwardly directed flange 90 locks into the v-shaped notch recessed 68 thereby locking the locking member 82 relative to the interconnecting collar 72. Further, the locking finger tip portions 92 are forced outwardly by the tapering wall 64 of the bag neck 44 into engagement with the edge portion 78 and in particular a corner therefor. This prevents the edge portion 78 from being squeezed together and also prevents a pressure force build up within the keg 22 that may force the interconnecting collar 72 out from the keg aperture 42.

What is claimed is:

1. An alcohol beverage container assembly comprising:

a keg having a keg aperture;

a bag contained in the keg for containing an alcohol beverage, the bag having a neck for supporting the bag in the keg, the neck having a peripheral wall portion sized less than that of the keg aperture, and the neck having a central passageway extending into the bag that is adapted to receive a beverage filling and dispensing valve assembly; and, an interlocking collar mounted in press fit surrounding relation with the peripheral wall portion of the neck, the collar having an outer peripheral wall portion sized larger than that of the keg aperture, characterized in that said keg has a flange defining the keg aperture and the collar has a recessed groove in the collar outer peripheral wall portion for receiving the keg flange in press fitting and sealing relation therewith, and the collar outer peripheral wall portion having a resilient edge portion adjacent the recessed groove that deflects to permit the interlocking collar to pass through the keg aperture and receive the keg flange in the recessed groove, wherein the interlocking collar has a plurality of locking passageways placed around the interlocking collar and axially extending through the interlocking collar between the neck and recessed groove, and the container assembly having a latch member with a plurality of locking fingers adapted to extend axially through the locking passageways to prevent deflection of the resilient edge portion of the interlocking collar.

2. The alcohol beverage container assembly of claim 1, wherein:

the peripheral outer wall portion of the neck comprises an out-turned flange for mounting the bag thereto, the neck has an inwardly tapering wall axially spaced adjacent the out-turned flange, a first recessed slot extending around the neck and axially spaced adjacent the inwardly tapering wall, and a second recessed slot extending around the neck and axially spaced adjacent the first recessed slot;

wherein the interlocking collar is received in the first recessed slot of the neck in press fit sealing relation therewith; and the latch member has a support base having an inner aperture defining an inwardly directed flange received in the second recessed slot of the neck in press fit, sealing, and locking relation therewith, and the locking fingers extend axially from the support base, and each locking finger has a lead-in finger tip portion that curves outwardly and abuts the tapered wall of the neck to be forced into locking engagement with the resilient edge portion of the interlocking collar.

3. The alcohol beverage container assembly of claim 2, wherein the second recessed slot comprises a v-shaped recessed notch.

4. The container assembly of claim 1, wherein the keg flange is raised.

5. An alcohol beverage container assembly according to claim 1:

wherein said keg aperture has a predetermined diameter, said peripheral wall portion of said neck has a second predetermined diameter being less than the first predetermined diameter of the keg aperture and wherein the outer peripheral wall portion of said collar has a third predetermined diameter greater than the first predetermined diameter.

6. The container assembly of claim 5, wherein the interlocking collar has a plurality of locking passageways placed around the interlocking collar and axially extending through the interlocking collar between the neck and recessed groove, and the container assembly having a latch member with a plurality of locking fingers adapted to extend axially through the locking passageways to prevent deflection of the resilient edge portion of the interlocking collar.

7. The container assembly of claim 6 wherein:

the peripheral outer wall portion of the neck comprises an out-turned flange for mounting the bag thereto, the neck has an inwardly tapering wall axially spaced adjacent the out-turned flange, a first recessed slot extending around the neck and axially spaced adjacent the inwardly tapering wall, and a second recessed slot extending around the neck and axially spaced adjacent the first recessed slot;

wherein the interlocking collar is received in the first recessed slot of the neck in press fit sealing relation therewith; and the latch member has a support base having an inner aperture defining an inwardly directed flange received in the second recessed slot of the neck in press fit, sealing, and locking relation therewith, and the locking fingers extend axially from the support base, and each locking finger has a lead-in finger tip portion that curves outwardly and abuts the tapered wall of the neck to be forced into locking engagement with the resilient edge portion of the interlocking collar.

8. The container assembly of claim 7 wherein the second recessed slot comprises a v-shaped recessed notch.

9. An alcohol beverage container assembly of claim 1, wherein said valve assembly comprises a valve body adapted for beverage filling and dispensing the alcohol beverage into and out from the bag.

10. An alcohol beverage container assembly of claim 5, wherein said valve assembly comprises a valve body adapted for beverage filling and dispensing the alcohol beverage into and out from the bag.

* * * * *